US005934820A

United States Patent [19]

Hinkle

[11] Patent Number: 5,934,820

[45] Date of Patent: Aug. 10, 1999

[54] MANHOLE COLLAR ASSEMBLY AND METHOD FOR PRODUCING SAME

[76] Inventor: Vernon W. Hinkle, 2418 Bishop Cir., Caldwell, Id. 83605

[21] Appl. No.: 09/079,242

[22] Filed: May 14, 1998

Related U.S. Application Data

[63] Continuation-in-part of application No. 08/988,870, Dec. 11, 1997.

[51] Int. Cl.[6] ..... E02D 29/14; E01C 7/00; E04G 17/00

[52] U.S. Cl. ..... 404/26; 404/25; 249/4; 249/5; 249/188; 249/219.1; 52/745.19

[58] Field of Search ..... 52/19, 20, 21, 52/745.19; 249/1, 2, 4, 5, 10, 11, 188, 189, 207, 210, 212, 219.1; 404/25, 26

[56] References Cited

U.S. PATENT DOCUMENTS

| | | | |
|---|---|---|---|
| 948,539 | 2/1910 | Clark | 249/11 |
| 1,030,384 | 6/1912 | Clarkson | 404/25 |
| 1,789,049 | 1/1931 | Nelson | 249/2 |
| 3,533,199 | 10/1970 | Pickett | 404/25 |
| 4,592,674 | 6/1986 | Baliva | 404/25 |
| 4,621,941 | 11/1986 | Ditcher et al. | 404/26 |
| 4,957,389 | 9/1990 | Neathery | 404/72 |
| 5,095,667 | 3/1992 | Ryan et al. | 52/20 |
| 5,263,298 | 11/1993 | Ballesteros | 52/742 |
| 5,386,669 | 2/1995 | Almeida | 52/19 |
| 5,419,856 | 5/1995 | Shaw | 264/28 |
| 5,492,656 | 2/1996 | Tracy | 264/32 |
| 5,634,739 | 6/1997 | Armstrong | 404/26 |
| 5,785,452 | 6/1998 | Milo et al. | 404/25 |

FOREIGN PATENT DOCUMENTS

| | | |
|---|---|---|
| 0 529 178 B1 | 1/1997 | European Pat. Off. . |
| WO 97/12096 | 4/1997 | WIPO . |

*Primary Examiner*—Thomas B. Will
*Assistant Examiner*—Gary S. Hartmann
*Attorney, Agent, or Firm*—Ken J. Pedersen; Barbara S. Pedersen

[57] ABSTRACT

The present invention provides a system, for raising a manhole ring during construction or roads, that includes placing a generally tubular form on a manhole cone in an excavation, and a method and trimming/cutting tool for adjusting the height of the form. Preferably, the cutting tool is positioned inside the form and is rotated around to cut a ring of material off of the top of the form. The cutting tool is set at an elevation, indexed off of the pavement around the excavation, which results in the form being cut to a height that can support a manhole ring at a proper elevation to be flush with the pavement surface of a particular site. Once the manhole ring is placed on the trimmed form, a single pour of concrete may be done to create a concrete collar that fills and seals the vertical space between the manhole cone and ring. The form may include a stabilizing system for holding the form in place on the manhole cone.

12 Claims, 8 Drawing Sheets

MANHOLE COLLAR ASSEMBLY AND METHOD FOR PRODUCING SAME

DESCRIPTION

This application is a continuation in part application of, and claims priority from, U.S. patent application Ser. No. 08/988,870, filed on Dec. 11, 1997, entitled "Manhole Collar Assembly and Method for Producing Same", the disclosure of which is incorporated herein by this reference.

BACKGROUND OF THE INVENTION

1. Field of the Invention

This invention relates generally to pavement construction and particularly to an improved construction for underground utility access assemblies. More specifically, the invention includes an improved construction for raising the manhole ring and cover to proper elevation, and a process and tool for producing the improved construction.

2. Related Art

Subterranean utility lines have been employed for many decades and have typically been laid adjacent to or beneath roadways. The need for access to utilities has necessitated the addition of access holes at various points along a utility line. These access holes are commonly called "manholes" and are covered with what is generally known as "manhole covers".

Manhole covers are generally comprised of cast iron, are circular in configuration, and have a suitable diameter for a particular utility or road construction project, typically, but not restricted to, 12–48 inches. In usage, the top surface of a manhole cover is generally flush with the pavement or road surface, so as to not generate a depression in the road, which would otherwise tend to be the source of a myriad of problems. On such problem would be the unnecessary bumps for traveling vehicles. Another such problem would be the creation of locations where water may accumulate and, by the expansive forces created by its freezing, cause discontinuity between the manhole ring and the surrounding pavement. Such discontinuities would then perpetuate a destructive process by admitting more water into the surrounding area, which could then aggravate the problem by similar subsequent freezing and thawing action. Therefore, a general requirement for both new road construction and reconstruction is that manhole covers be generally flush with the pavement surface.

In the case of new road construction, current practice is to supply a pre-cast concrete manhole cone 10, also called a "cone section", which is put in place in an excavated hole over the buried utility line at the job site. These concrete manhole cones extend upward from the buried utility line to usually less than 2 feet below the road surface. This distance between the cone and the road surface allows for installing the manhole ring (onto which the manhole cover is located in its final assembled position) in such fashion as to provide a flush fit between the manhole cover and the road surface. The distance between cone and road surface is greater than the height of the manhole ring, so that there is a void space between the top of the concrete cone section and the bottom of the manhole ring. In conventional practice, this space is typically filled with bricks, mortar, cement block, or pre-cast concrete circular grade rings 14 of different thickness grouted in place. After the manhole ring is raised above the cone by these bricks or grade rings to the proper elevation and orientation, concrete 20 is poured around the bricks or grade rings and the manhole ring to form a sealed system extending from the cone to the manhole ring. Because the manhole ring is initially buried with the cone beneath the fresh pavement, and then uncovered and raised into correct position by the grade ring technique, the process of lifting and positioning the manhole ring is called "raising".

In the construction of such prior art systems, difficulty is encountered in the raising process, particularly at the stage where it is desired to make the surface of the manhole ring and cover flush with the final road surface. The difficulty in matching the paved surface is of special concern for construction of new road surfaces. Currently, as discussed above, the pre-cast concrete grade rings are available in varying thickness to allow for custom adjustment as each individual case requires, and these rings are set in grout to obtain the final required height adjustment. Still, the adjustment of a manhole ring location by this technique tends to be inaccurate and time-consuming. Also, the pre-cast grade rings are costly and cumbersome to use.

It is an object of the present invention, therefore, to alleviate the necessity to use pre-cast concrete grade rings, bricks, or blocks in these constructions. It is a further object of the present invention to reduce the overall cost and difficulty of construction of utility line access systems.

SUMMARY OF THE INVENTION

The instant invention comprises a forming system to create a concrete collar around the access opening for underground utility maintenance. The forming system comprises a pre-fabricated form, and a trimming assembly for on-site custom trimming of the form to the proper height and orientation, for accurate placement of the manhole ring to be level with the paved road surface. The system permits the installer to construct the support for the manhole ring in one continuous pour, thereby greatly increasing labor efficiency and decreasing material costs. No experimentation with concrete grade rings of varying thickness is required when using the system of the instant invention.

The form of the invented system comprises a generally tubular-shaped, preferably slightly conical, section composed of material having upper and lower ends when installed in its functional location on a manhole cone that extends upwardly from the particular subterranean utility area that is to be accessed. Once properly installed, the form is generally coaxial with the cone, and the form's lower end rests upon the top surface of the concrete manhole cone. On the upper end of the tubular form, after custom trimming of the form, is rested a manhole ring 16, which serves as the receiving receptacle for a manhole cover later placed thereon. The initial height of the tubular concrete form 22 (prior to custom trimming) is selected so that it extends at least slightly higher than the location where the bottom surface of the bottom flange of the manhole ring 16 is eventually to be. This allows leeway for the custom trimming of the tubular form, preferably using the invented trimming assembly, to a height and orientation that will result in the manhole ring top surface being the same elevation as the adjacent asphalt surface.

The invented trimming assembly comprises a support that holds a trimming tool at a proper elevation below the pavement, that is, where the bottom of the manhole ring should be. The trimming assembly further comprises means for rotating the trimming tool around in this proper elevation, that is, parallel but below the plane of the pavement, to cut off the top of the form at that elevation. After the trimming is complete, the trimmer is removed and the manhole ring is repositioned atop the trimmed upper end of the tubular form. Once the ring is in this proper position, concrete is poured around the outside of the invented form in the space between the pre-cast concrete manhole cone and the top of the manhole ring to form the concrete collar. After the initial setting of the concrete, the tubular form may be removed, although such removal is not necessary and provides added protection of the concrete collar from corrosive gases.

The principle objects of this invention are to provide an efficient labor and cost-effective method for raising manhole rings to proper position relative to road surfaces, which reduces the total time required for such raising.

DESCRIPTION OF THE PREFERRED EMBODIMENTS

Figure 2:
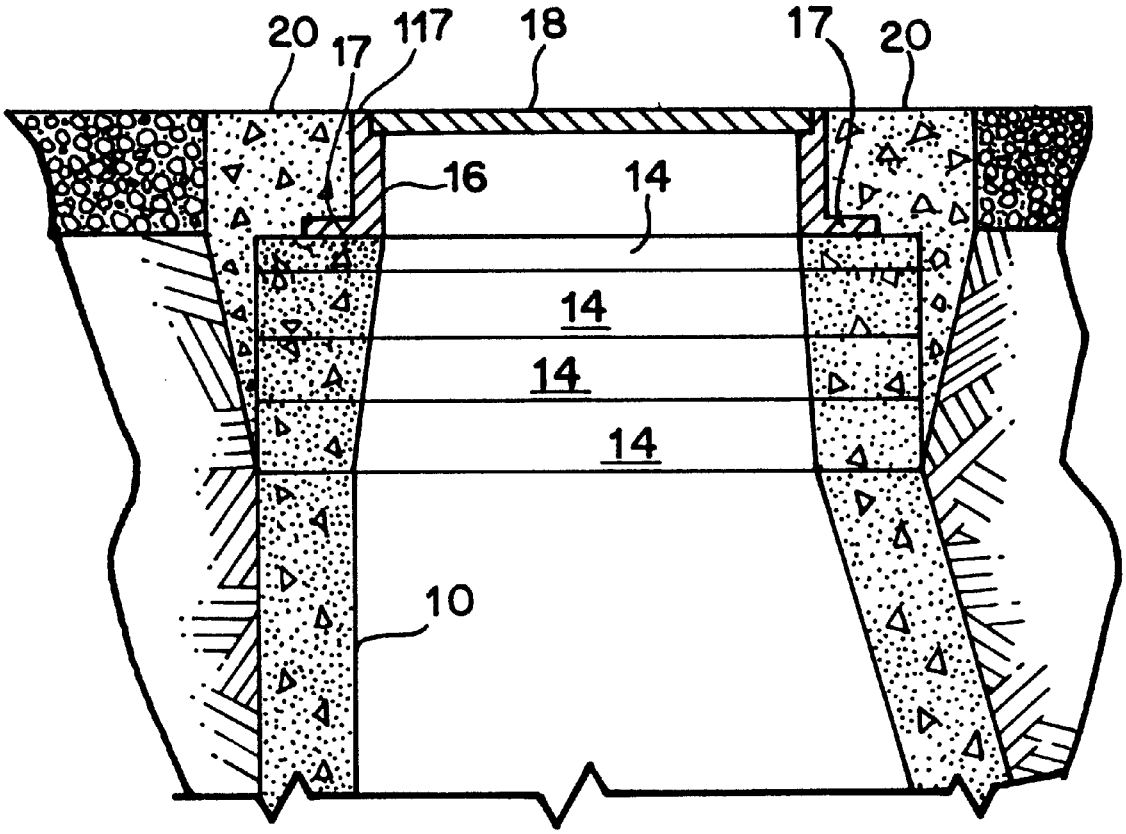
PRIOR ART FIG. 2
FIG. 2 is a cross-sectional view showing the prior art method of construction using concrete grade rings 14 and grout.

According to the instant invention, there are shown in the Figures several embodiments of apparatus and methods for producing a manhole ring perfectly indexed to the adjacent paved road surface. The invention is used to replace cumbersome and inaccurate steps of the conventional technique for raising a manhole ring, which are schematically illustrated in FIG. 2.

In the conventional technique, earthwork serving as the subbase material is provided and compacted to a sub-grade elevation which is below the ultimate paved grade elevation. A precast concrete manhole cone 10 having a metal manhole ring 16 and cover 18 placed atop its opening is provided where underground utility access is required. A layer of base rock substance, which typically consists of gravel, is then placed over the sub-base material. At this stage, the manhole ring and its cover are buried beneath the base rock. The final asphalt road surface material is then placed over the base rock to provide a smooth road surface by means well known to those skilled in the art, and the road surface is permitted to fully cool.

After the asphalt paving has cooled, the location of the manhole rings and covers previously buried by the base rock and asphalt paving are determined (using, for example, metal detectors), and a circular section comprising sub-base, base rock and asphalt paving, approximately 1 to 6 feet in diameter, is excavated from the region above and around the manhole ring and cover. This excavation is undertaken to the extent necessary to expose the top surface of the concrete manhole cone 10, the manhole ring, and the cover itself. The ring and cover are removed from their positions on the cone and set off to the side.

After these conventional steps are performed, the invented system is used to create an improved concrete collar to raise the manhole. The system comprises use of an invented concrete form and trimming the form prior to a single collar-forming concrete pour.

The invented tubular form 22 is originally comprised of a material that is preferably formed into a wall 23 with the shape of a tube with a slightly conical shape. The form wall may be made of a sheet of material rolled into a tube and fastened at its seam by welding, overlapping, use of a strip of similar material located along the seam incorporating suitable fasteners (such as rivets), or other fastening means. Also, these forms may be molded into a single seamless piece or several fastened pieces. The preferred form material is plastic, but other materials may be used: wood, metal, composites, homogenous or layered sheets, or screens covered with sheeting may be used, or other materials that are strong enough to support a concrete pour.

Inside the wall 23 of the form 22 is preferably, but not necessarily, a stabilizing assembly 69 for reinforcing the form wall 23 and helping to anchor the wall in proper position on the cone. The preferred stabilizing system comprises a compression-resistant frame inside the wall 23 and a weight 76 for holding the form in place.

Figure 3:
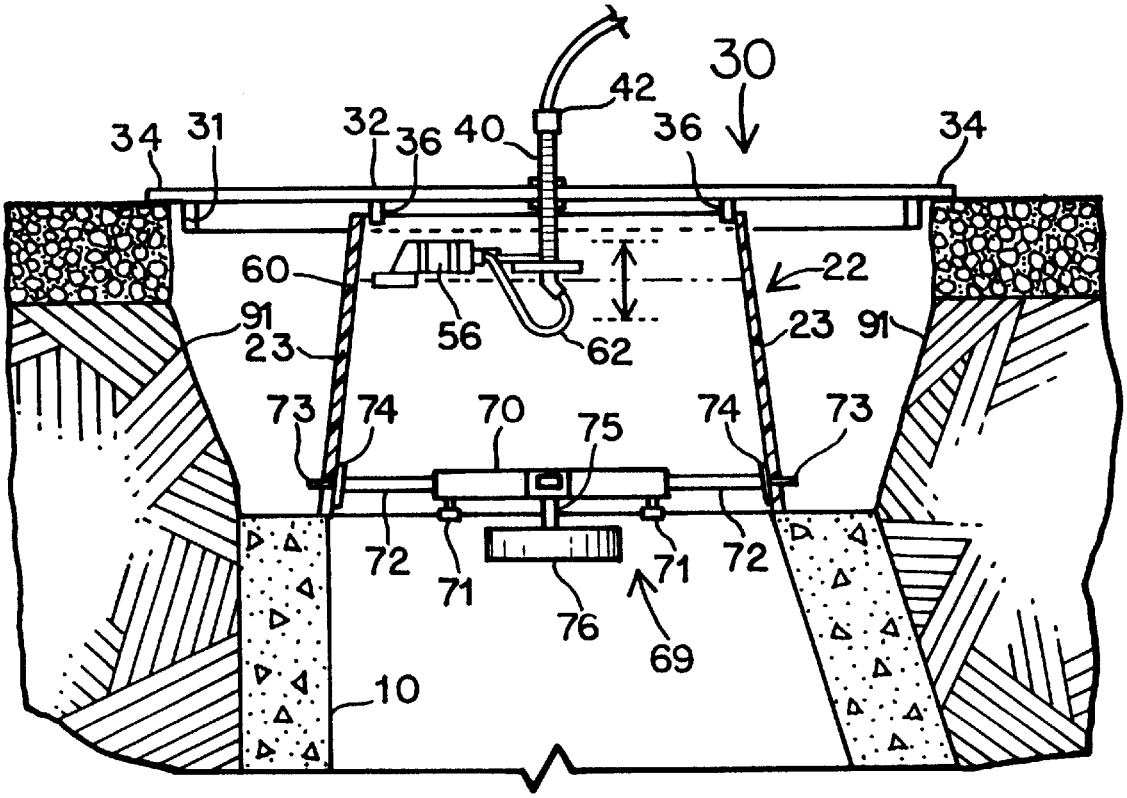
FIG. 3 is a cross-sectional view showing the trimmer system embodiment of FIG. 1 in position on one embodiment of the invented concrete form, the trimmer system in place to trim the form to required height and orientation prior to final positioning of the metal manhole ring.
Figure 6:
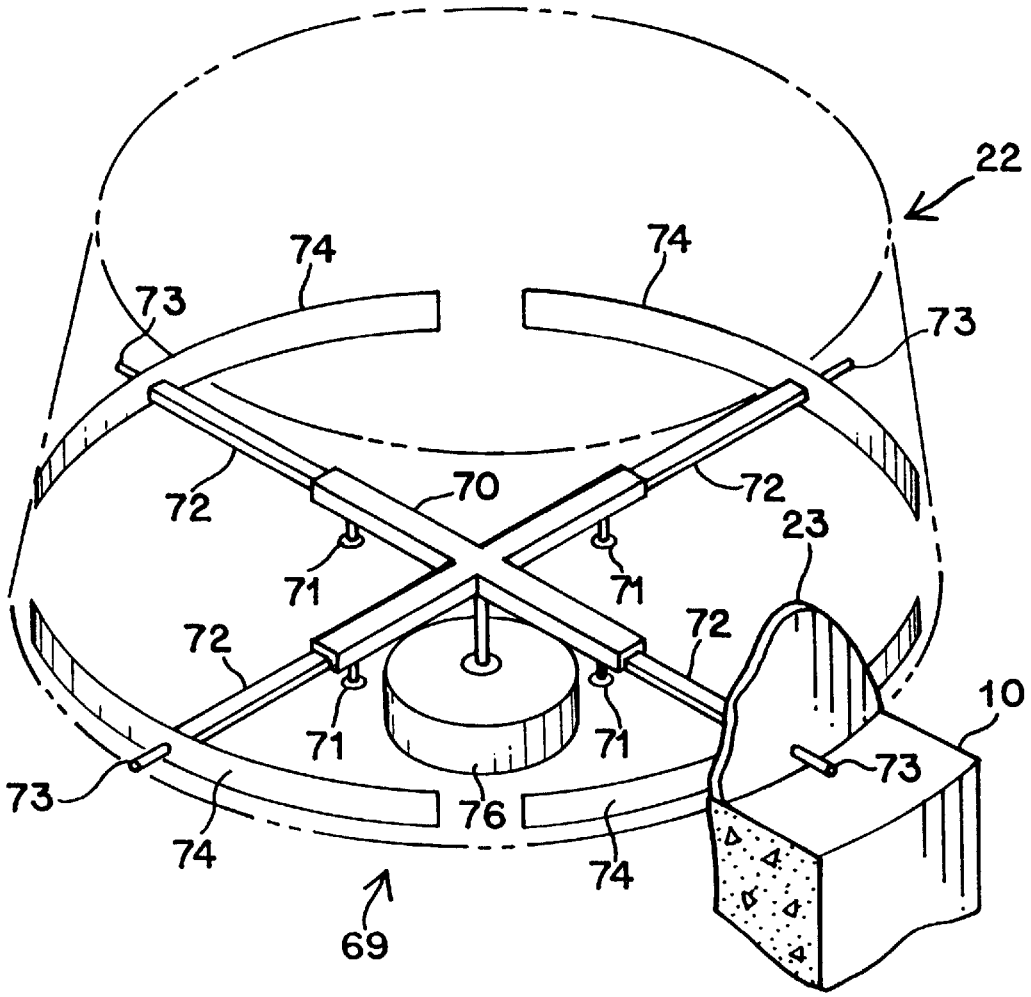
FIG. 6 is an enlarged perspective view of a stabilizing/positioner assembly of the form embodiment of FIG. 3, including a frame, adjustable rods, support strips, and weight.
Figure 8:
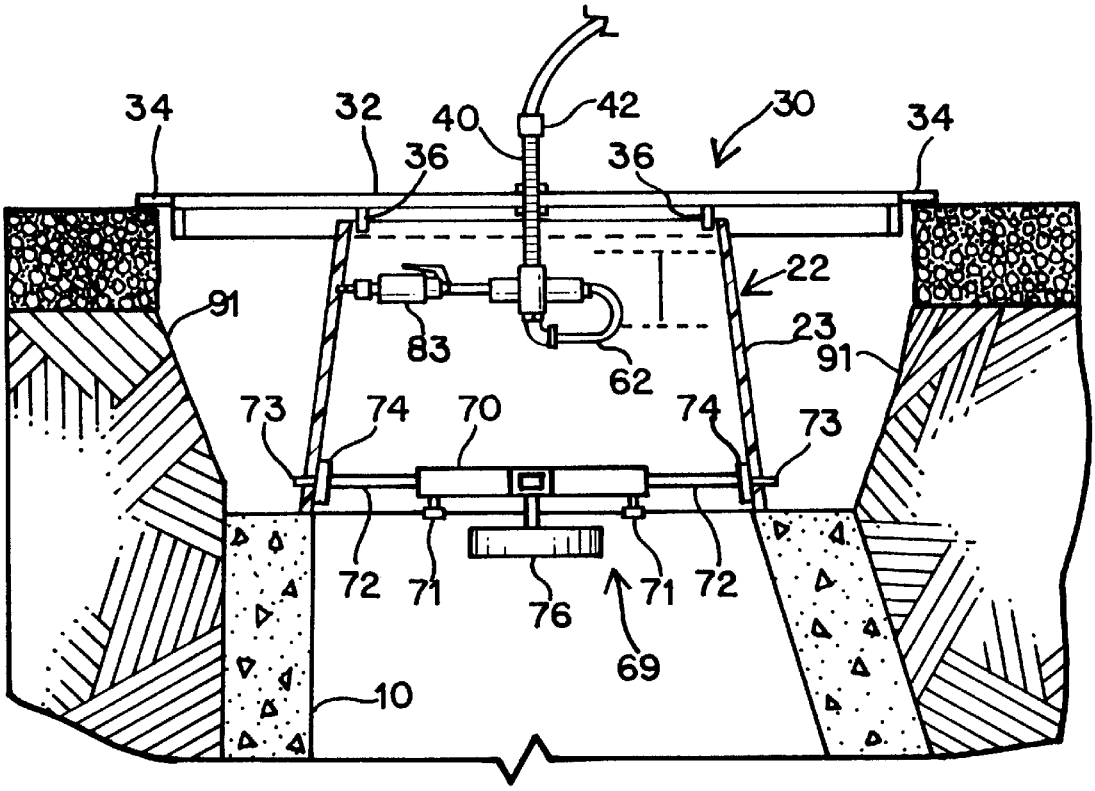
FIG. 8 is a cross-sectional view showing the trimmer system embodiment of FIG. 7 in position on one embodiment of the invented concrete form.

The frame comprises a plurality of stabilizing and weight-positioning rods 72 located inside form 22 as shown in FIGS. 3, 6, and 8. These stabilizing rods, which telescope into arms 70, have ends 73 which extend into or through the wall, or fasten to the wall by other means. The exact location of the stabilizing rods along the height dimension of the tubular form 22 is not extremely critical for purposes of this invention. The function of the rods is to assist in stabilizing the form during the trimming operation and the subsequent setting time of the concrete and this function may be accomplished with the rods being at various heights. The location of the rods is preferably at an effective distance from the lower end of the tubular form for this purpose. The stabilizing rods 72 are housed within an x-shaped rigid framework 70 having a clamping means 71 that, when tightened against a portion of a rod 72, holds the rod in a fixed radial length and position. By such means, adaptation to tubular forms 22 of varying diameters is possible by simple adjustment of the length of rod protruding from the x-shaped framework.

Alternately, a single stabilizing rod may be used with a straight rectangular or tubular outer framework analogous to 70 similarly equipped with clamping means and a sliding or telescoping inner member which is readily adaptable to preferably removably attach to the walls of form 22.

Near the outer extremities of the stabilizing rods are preferably semi-circular reinforcing support strips 74 which push on the lower end or "skirt" portion of form 22 to reduce or eliminate the tendency of the tubular form 22 to bow inwards under the forces applied by the concrete having been poured around the form. Thus, the strips 74 preferably are biased against, contact, or are very near the form wall inner surface in the lower half of the form. The strips, rods, and x-shaped framework act to resist compression forces from outside of the form, which might otherwise collapse, bow or warp the form wall.

From the vertex of the stabilizing frame is hung a weight 76, which is of an amount sufficient to hold the concrete form 22 in place, for example, about 20 pounds. The weight is preferably centered to be coaxial with the form wall and is slightly below the form. The weight may be hung by a strap, chain, wire, or any means, or may be generally integral with the stabilizing frame. The weight assists in holding the concrete form 22 in position during the trimming stage, and may be left in place during the setting of the concrete.

Alternatively, the stabilizing system may be of other designs. The system may be as simple as the form being made of very heavy material, or having some means for attaching or clamping the form wall to the cone. The stabilizer system may have other than an x-shaped structure, and may comprise other rings, panels, or reinforcers besides the strips 74, and may include a simple chain or cable attached to the stabilizer from which a weight is suspended. For example, an expandible ring may be inserted into the form to extend generally continuously around the inside surface of the form. The expandible ring may have a chain or cable extending from side to side across the form opening and have a weight hanging from the chain. The expandible ring may have prongs or other protrusions to grip the inside surface of the form 22.

The trimmer jig frame comprises an outer support for contacting the pavement and an inner support that holds and cooperates with the cutting tool. The preferred jig frame 30 supports the trimmer of this invention in its desired position using an outer support comprising a circular member 31 and an inner support comprising an x-frame 32. The jig frame 30 is next positioned over the form 22. The jig frame 30 optionally may be held in position by means of vertical positioning tabs 36, which fit snugly against preferably the inner surface of the tubular form 22, and horizontal exterior tabs 34, which rest upon the flat portions of the finished road top surface that was not removed by the excavation of the approximately 1-to-6-foot section previously mentioned. Such a configuration tends to hold the form 22 in a fixed position relative to the excavated hole and to the trimmer for the trimming operation.

The generally x-shaped jig frame 30 is preferred because it is strong, economical to manufacture, and convenient to use. The x-frame 32 allows the operator to swing and watch the cutting tool without significant obstructions to the hands and vision. Alternatively, however, other jig frame shapes may be used, with various radial or ring or other bracing members, and various positioning members for holding the frame in place. Also, other rotational members may be used, although the shaft 40 and bushing 48 system is effective and economical.

The amount of tubular form 22 to be trimmed away by the invented trimmer is readily determined by measuring the critical dimension of the manhole ring 16. These manhole rings conventionally have an upper surface 117 that, after installation, is flush with the finished road surface. The manhole rings have a lower flange 17 and a coextensive lip portion 19 which defines the diameter of the access hole and which is the lowermost portion of the manhole ring itself The lip projects inside into the top of the custom trimmed tubular form. The distance between the upper surface of the manhole ring and the bottom surface of the flange is called the critical dimension, and is determined by measuring. Then, the bit 84 or other cutting/trimming member is positioned at that same vertical distance from the portion of the x-frame that is level with the pavement, for example, the bottom surface of tabs 34 that rest on the concrete or the top or bottom surface of the x-frame members 32, depending on which surface is designed to be at the level of the pavement surface. Vertical adjustment of shaft 40, which is accomplished as described in the Trimming Operation section, is used to position the cutting trimming member at the critical dimension.

The various portions of the invented form stabilizer assembly and the trimming/cutting jig frame are preferably constructed of steel or aluminum. However, any materials that are rigid enough to adequately provide stable, stationary support may be used. For example, other metals beside aluminum or steel, various alloys, fiberglass, graphite, etc., could be used. The stabilizer assembly for the form should hold the form stationary and should reinforce the form wall against collapse or warping under the pressure of the poured concrete. The trimming/cutting jig frame should hold the trimming/cutting tool in proper and accurate position while the cutting operation is being carried out. The jig frame preferably should be designed to remain in stationary relationship to the form, the excavated hole, and the manhole cone.

Figure 1:
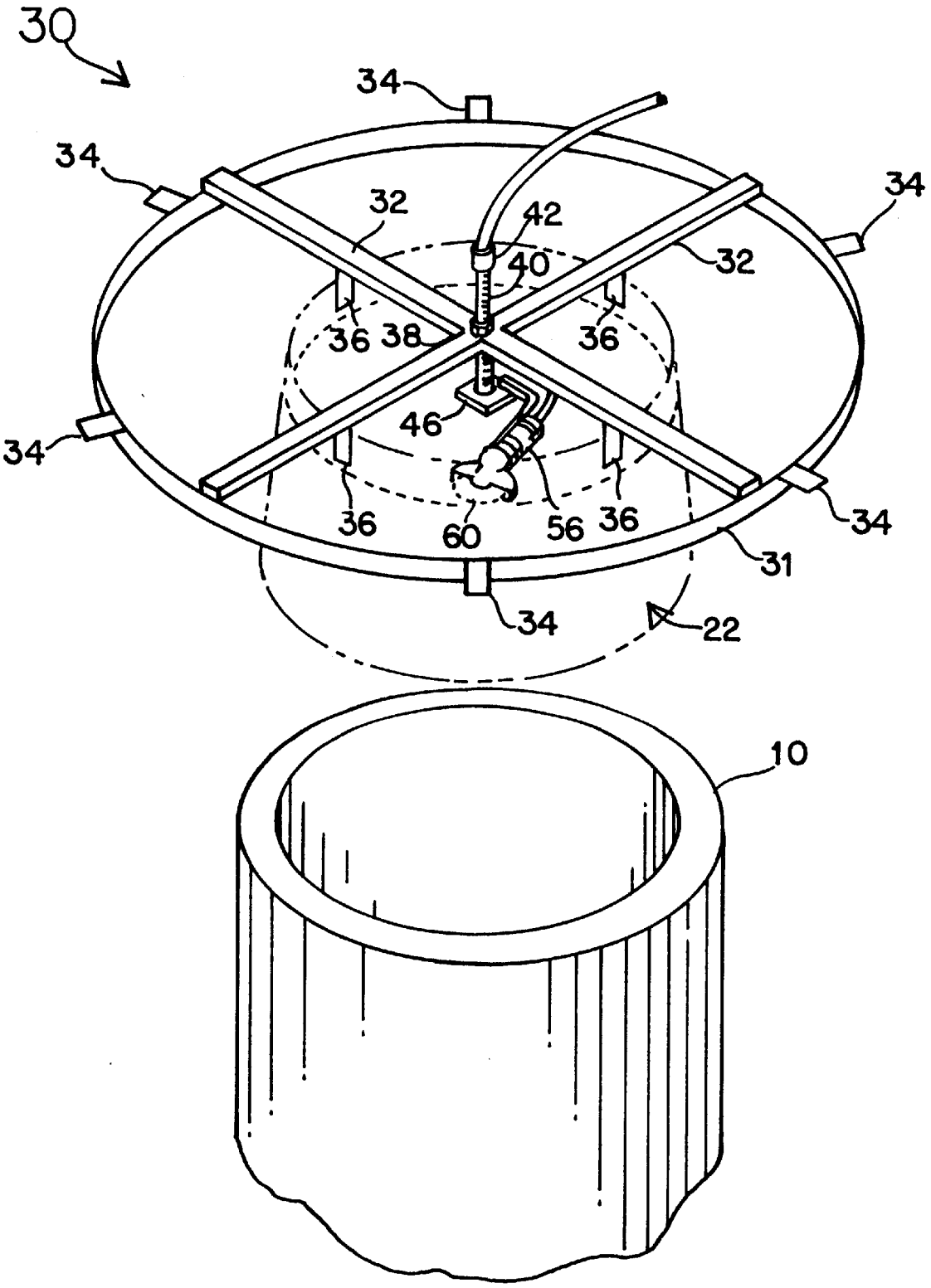
FIG. 1 is a perspective, exploded view of one embodiment of the invented concrete trimming system, in place on an embodiment of the invented form (shown in dashed lines) above a manhole cone.
Figure 5:
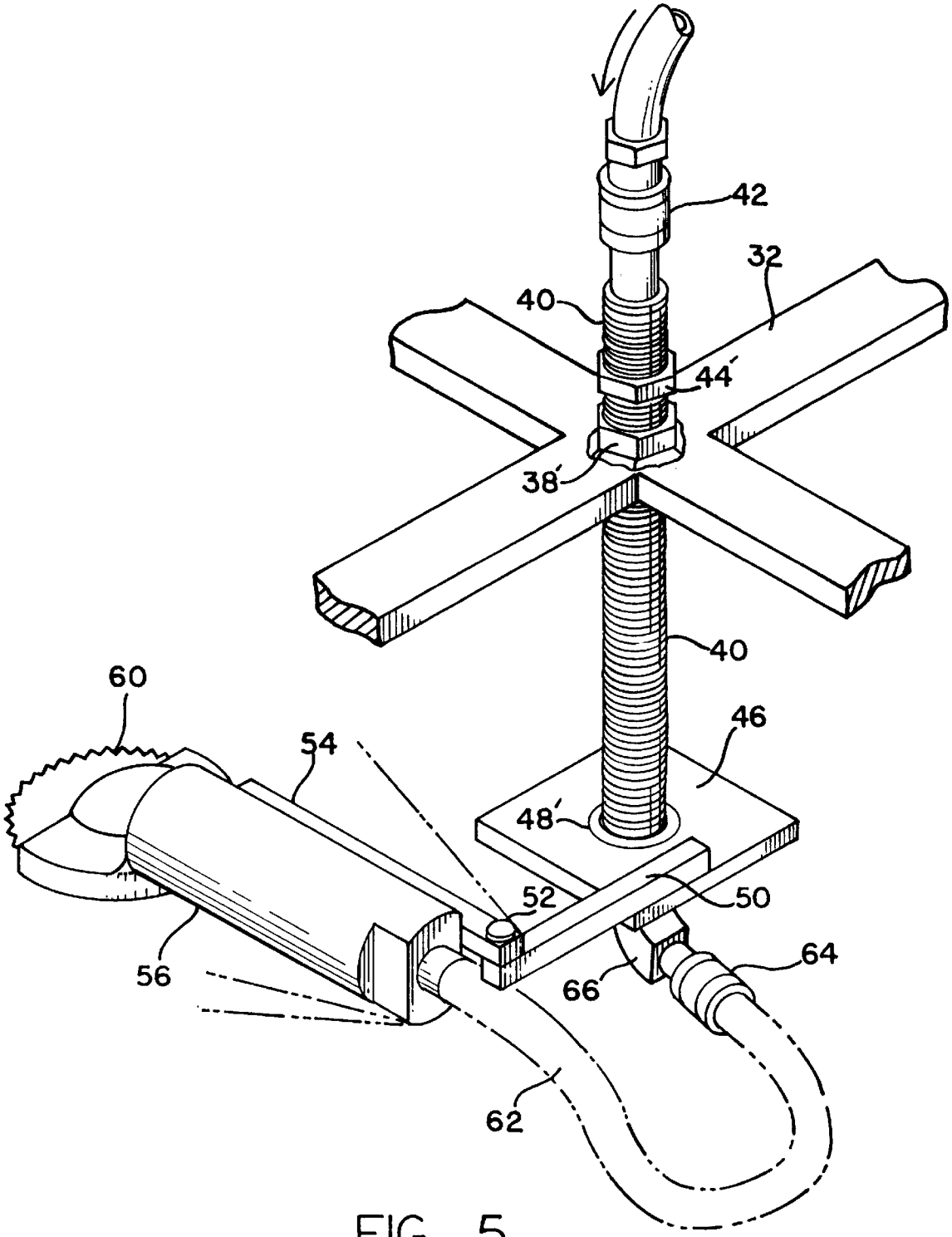
FIG. 5 is an enlarged perspective detail view of the trimmer system embodiment of FIGS. 1 and 3, showing a depth-adjusting center post, telescoping swing arm assembly, and a cutting means.
Figure 7:
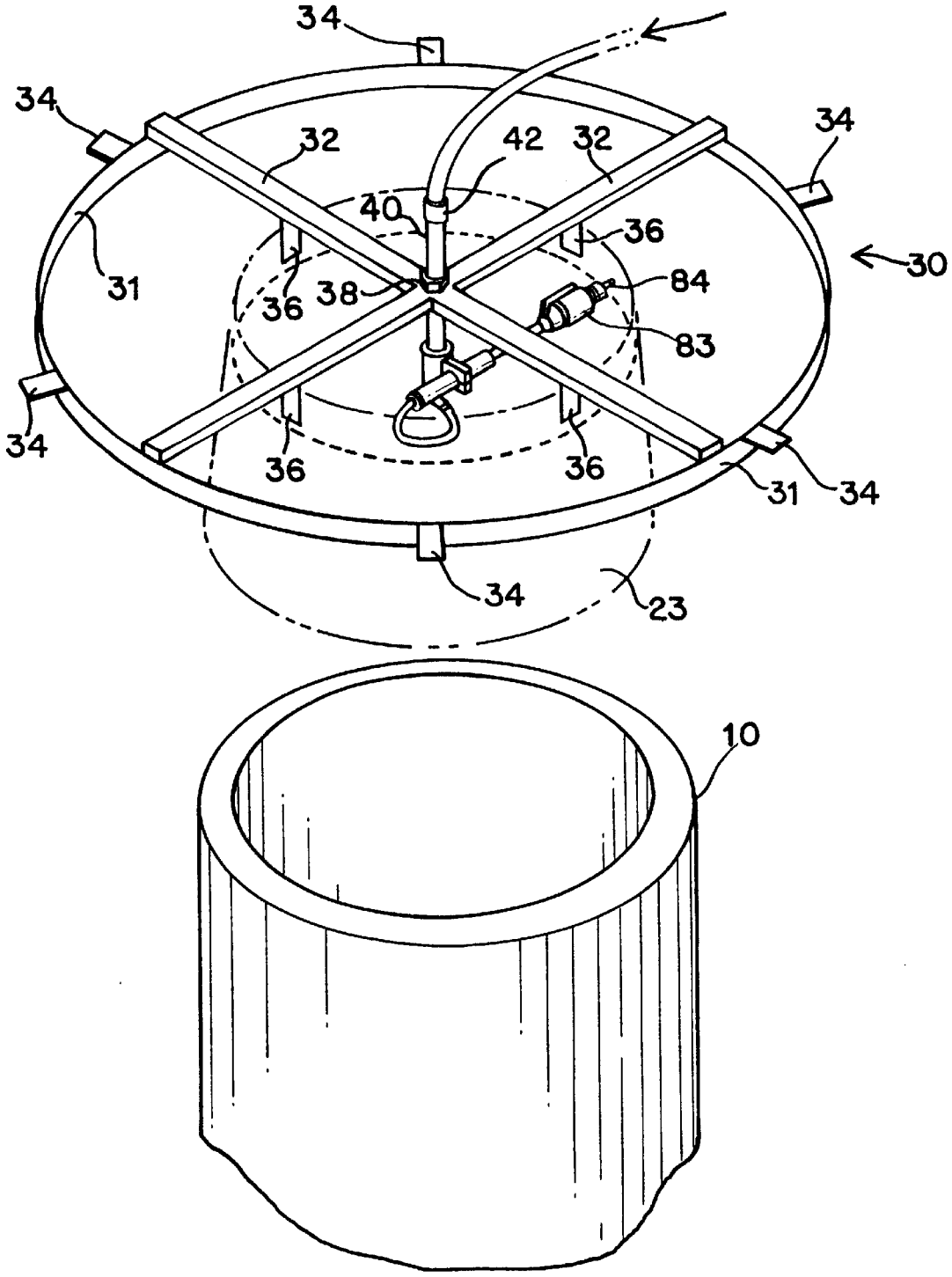
FIG. 7 is a perspective, exploded view of another embodiment of the invented concrete trimming system, in place on an embodiment of the invented form (shown in dashed lines) above a manhole cone.
Figure 9:
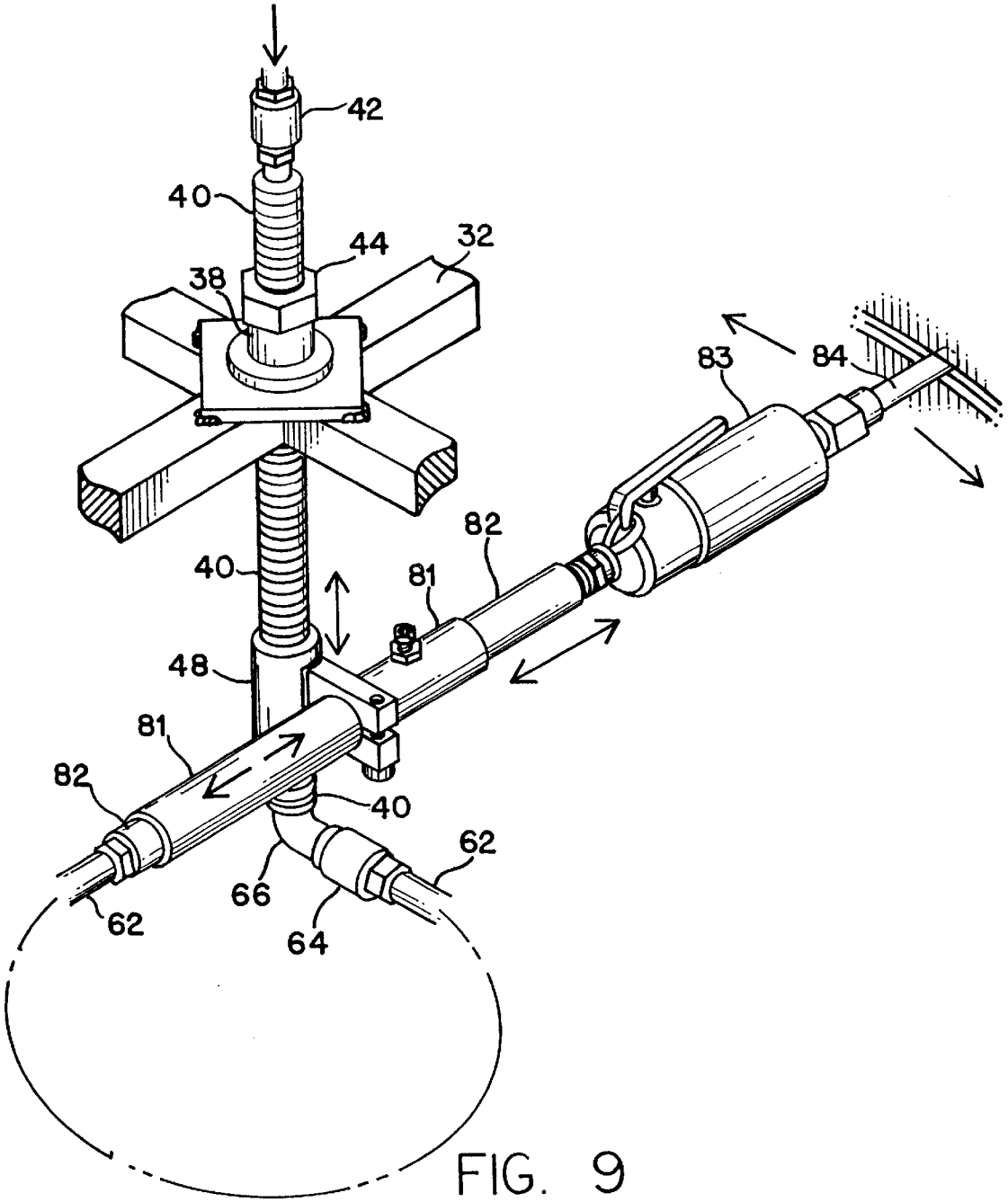
FIG. 9 is an enlarged perspective detail view of the trimmer system embodiment of FIGS. 7 and 8, showing a depth-adjusting center-post, swing arm assembly, and a cutting means which includes a die grinder with a router bit.

Various cutting means may be used in accordance with the invention. For example, a grinder, saw, knife, laser, puncture or perforation device, or a burning tool may be used, or any means for removing form wall material near the top of the form. FIGS. 1, 3 and 5 illustrate a saw as a cutting means, while FIGS. 7, 8 and 9 illustrate a grinder as a cutting means. Various substitutes may be envisioned, depending on the material chosen for the form wall material.

In the case when a pneumatic die grinder 83 with router bit 84 is employed, conventional air hoses and connecting means are employed to convey compressed air to the trimming means. Other pneumatic or electrical apparatus may be used to power the trimming/cutting tool.

The Specialized Trimmer

Embodiments of the device specifically developed for trim adjustment of the tubular form 22 of this invention are shown in use in FIGS. 1 and 3, and FIGS. 7 and 8 and are detailed in FIGS. 5 and 9. The preferred embodiment of FIG. 9 comprises an electric, or more preferably a pneumatic die grinder 83, for example, one manufactured by the Sioux Tools Inc., Sioux City, Iowa, model 1954HP or an equivalent. The grinder 83, including router bit 84, is mounted on a telescoping arm 82, which slides through swinging arm 81. Swinging arm 81 is the outside tube attached to center post 40 by means of bushing/bearing 48, which allows the complete assembly of the swinging arm 81, telescoping arm 82, and die grinder 83 with router bit 84 to rotate concentrically around center post 40 to cut/trim concrete form 22. An adjustable shaft 40 connects bushing 48 and x-section 32. The adjustable shaft 40 is hollow throughout its length dimension so as to function as a passageway for either compressed air or an electrical wire useful for supplying motive force to the cutting/trimming device. The shaft 40 preferably is vertically adjustable up and down and lockable in a desired vertical elevation. For example, adjustable shaft 40 may be threaded on its external surface and mounted to x-frame 32 by means of threaded collar 38 cooperating with shaft 40. Alteratively, the shaft could have a smooth external surface and could cooperate with a mating, lockable collar or other mount. X-frame 32 may be attached to circular portion 31 of the jig frame 30 by various methods, such as welding or other fasteners. Various means may be used to lock the shaft 40 in place, after it is adjusted to the proper location, to prevent it from further rotating to a higher or lower position. A lock nut 44 may be used, for example, or other locking mechanisms.

Preferably, the die grinder 83 is pneumatic and compressed air is conveyed in from the inlet quick-disconnect fitting 42, through the air outlet feed elbow 66, quick-disconnect fitting 64, and short flexible air line 62. Such fittings and hose collectively are means for conveying compressed air to a tool and are well-known to those skilled in the art. Equivalently, when an electric motor is used, wiring is used in an analogous fashion to the compressed air conveyance system by means well known to those skilled in the electrical art. The purpose of the preferred quick-disconnect fittings 42 and 64 is to allow convenience in assembly/disassembly of the device, but such quick-disconnect fittings are not required.

The less preferred trimming embodiment of FIGS. 1, 3 and 5 includes a pneumatic saw 56 having blade 60, for example, one manufactured by the Jet Company of Auburn, Wash., model JSG-0519 or an equivalent. Blade 60 is mounted on a swing arm 54 by fastening means such as machine screws and/or brackets and clamps. The swing arm 54 is pivotally mounted by means of a hinge pin 52 to a fixed arm 50 which itself is rotatably mounted to a base plate 46 by means of a suitable coupling 48, which may be either a busing or a bearing. The adjustable shaft 40 is disposed between base plate 46 and x-frame 32, extends through collar 38' and may be locked by nut 44'.

The Trimming Operation

After determining the depth of the form wall material to be trimmed away, and after locating the jig frame 30 and the tubular form 22 in position as described above, the location of router bit 84 is appropriately adjusted by raising or lowering rotating post 40 until the bit is in the desired position. Then the post 40 is locked into position. Compressed air is supplied to the die grinder 83 and the operator causes the router bit 84 to contact and cut through the wall of the tubular form 22. The die grinder is rotated about the axis of rotation coinciding with shaft 40 by virtue of coupling 48 until a complete concentric cut has been made about the tubular form 22. After the cutting job is complete, the compressed air supply is disconnected and the die grinder assembly together with the jig frame 30 are removed from the form. The section of tubular form 22 which was trimmed away is then removed from the area.

Manhole Collar Installation

Following removal of the trimmed away section of the tubular form, the manhole ring 16 is placed atop the tubular form. The preferred measuring and trimming procedure results in the upper surface or "lip" of ring 16 being generally flush with the finished road surface at this stage, but, alternatively, any desired height or depth for the ring may be selected during the measuring and trimming procedure.

Concrete is poured into the space defined by the exposed top surface of concrete manhole cone 10, the outer surface of tubular form 22, the excavation wall 91 produced from the earlier excavation, and the plane of the finished road surface. Such a method allows monolithic pouring of the manhole collar to fill the space conventionally filled with grade rings, and, thus, the invented method provides an increase in efficiency, decrease in production time, better quality control, and savings of resources of significant cost.

Figure 4:
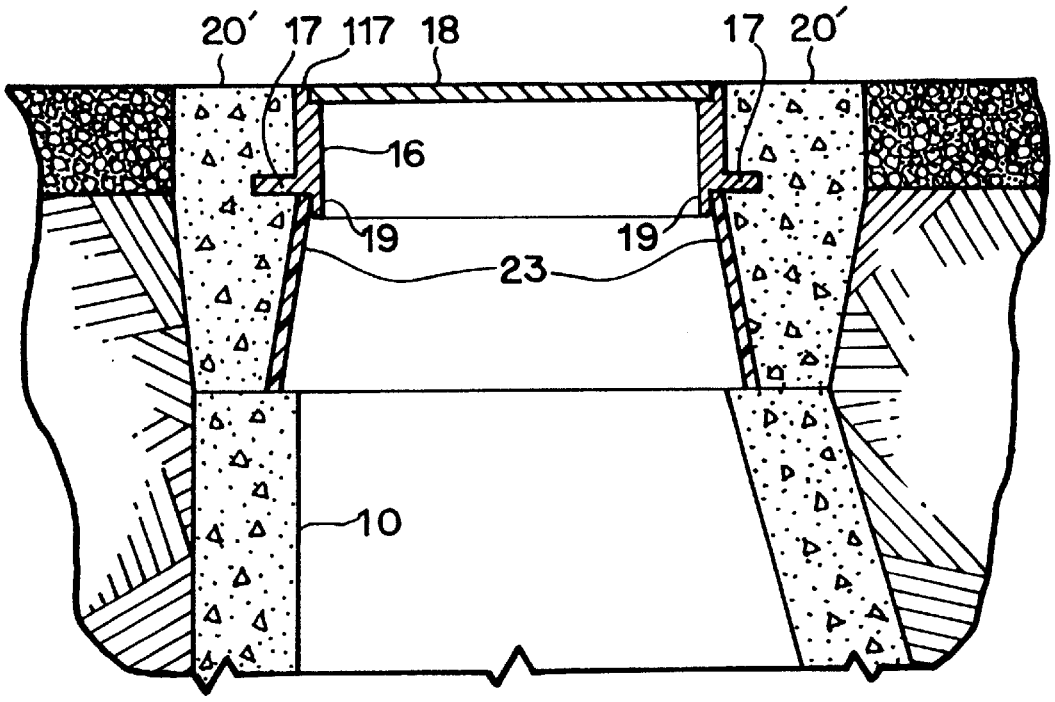
FIG. 4 is a sectional view showing the trimmed form of FIG. 3 in place with a manhole ring above it and concrete collar around it according to one embodiment of the invented method of construction.

Once the poured concrete collar 20' has cured sufficiently, the stabilizing assembly of the form 22 may be removed. At this stage, the form wall 23 also may be removed, if desired, although such removal is not essential or even desirable. The manhole cover is then placed in position on the manhole ring to complete the construction, which is illustrated in FIG. 4.

For purposes of the instant specification and the appended claims, the slightly conical, tubular concrete form may be made of any material suitable for shaping the form that can be readily cut or trimmed. The form wall should be strong enough to withstand, without warping or collapsing, the forces applied during trimming and during concrete pouring, or the wall should be reinforced accordingly.

The form 22 is preferably, but not necessarily, a single, solid, unitary molded or curved and fastened wall, having a substantially perforation-free outer surface, except for, optionally, small perforations for the stabilizer rods. A tubular and slightly conical shape is preferred, but other shapes may be used, for example, forms with oval or even rectangular outer surfaces. The alternative shapes may be adequate as long as they result in a concrete collar that will support the manhole ring, as long as they provide an outer surface that creates a barrier extending between the cone and the position where the manhole ring will be, and as long as the form leaves an interior space free of concrete for access to the interior of the cone from the manhole ring. The typical form 22 will be between 12 to 48 inches in diameter, but other diameters may also be used.

The form 22 may be made of various plastics, polymers, metal, composites, wood, etc., with the requirements being that: 1) sufficient wall strength be made available by the material or that a reinforcement/stabilizing system inside the form cooperate with the form wall to adequately act as at least a single-use concrete form, and 2) that the top region of the form wall be cuttable, trimmable, tearable, shearable, or otherwise adapted so that incremental portions of the top may be removed to custom-size the height and orientation of the form.

"Height adjustment" means that a ring of material will typically be removed from the top of the form. "Orientation adjustment" means that one side of the top of the form may be shaved, trimmed, cut off slightly more than another, to account for the fact that the manhole cone may be sitting at a slight angle in the excavation and that, therefore, the top of the cone and the form may also be sitting at a slight angle. Because the invented trimming assembly rests on the top pavement surface, it may be said to be referenced or "indexed" to the pavement surface, so that the trimmer/cutter will rotate around its axis/shaft 40 that is generally perpendicular to the pavement surface and cut the form in a plane parallel, but below, the plane of the pavement surface near the excavation hole. Therefore, despite angled positions of the cone and form, the cut resulting from the invented trimmer assembly will properly orient the top edge of the form to receive and support the manhole ring so that it is parallel with the pavement surface.

The invented system, therefore, does not require bricks, pre-fabricated rings, grout or other "building block" pieces stacked up above the cone. The invented system does not require trial-and-error in selecting rings of various thickness or in grouting the rings to build up the structure to an appropriate height. Rather, the invented uses the pavement surface as the reference to accurately create a form wall for a single concrete pour.

Although this invention has been described above with reference to particular means, materials and embodiments, it is to be understood that the invention is not limited to these disclosed particulars, but extends instead to all equivalents within the scope of the following claims.

I claim:

1. A process for raising a manhole ring to a desired elevation and orientation relative to a pavement surface around a manhole excavation, the process comprising the steps of:

providing a tubular form having an outer surface, an upper edge, a lower edge, and a height between the upper edge and lower edge;

placing said tubular form lower edge upon an upper surface of a concrete manhole cone in an excavation, so that the tubular form extends a height above the cone and is generally coaxial with the cone;

trimming the tubular form with a trimming tool, after said tubular form is on the manhole cone, by cutting the form near the upper edge and removing a portion of the form to produce a tubular form trimmed top edge parallel to and below a pavement surface around the excavation;

placing a manhole ring having a lower flange, an upper surface, and an outer surface, atop said tubular form so that the manhole lower flange rests on and is supported by the trimmed top edge of the tubular form; and pouring concrete around the outer surfaces of said tubular form and manhole ring.

2. The process of claim 1, wherein the tubular form has an interior space, and the process further comprises adjusting the trimming tool to a desired elevation below the pavement surface, and wherein the trimming step comprises rotating the trimming tool in the interior space around an axis generally perpendicular to the pavement surface to cut the form.

3. The process of claim 1, wherein the tubular form has an interior space, and the process further comprises adjusting the trimming tool to a desired distance below the pavement surface around the excavation, and wherein the trimming step comprises moving the trimming tool in the interior space in a plane parallel to the pavement surface to cut the form.

4. The process of claim 1, wherein the manhole ring has a height between the upper surface and the lower flange, wherein the process further comprises moving the trimming tool to a distance below a pavement surface equal to the height of the manhole ring, and wherein trimming the tubular form comprises producing the trimmed top edge of the form parallel to the pavement surface and below the pavement surface a distance equal to the height of the manhole ring.

5. The process of claim 1, wherein no concrete grade rings are placed in the excavation around the outside surfaces of the manhole ring and the tubular form.

6. The process of claim 1, wherein the trimming tool is a grinder.

7. The process of claim 1, wherein the trimming tool is a saw.

8. A raised manhole ring and collar assembly made by the method of claim 1.

9. A process for raising a manhole ring to a desired elevation which comprises the steps of:

providing a tubular form having an outer surface, an upper edge, a lower edge, and an interior;

placing said tubular form upon an upper surface of a concrete manhole cone generally coaxially with the cone;

placing a manhole ring atop said tubular form generally coaxially with the form, the ring having an outer surface; and pouring concrete around the outer surfaces of said tubular form and manhole ring;

wherein said tubular form includes at least one stabilizing member in its interior, and a stabilizing weight suspended from said stabilizer member.

10. The process of claim 9 wherein said stabilizer rod includes an end portion which connects to the wall of said tubular form.

11. The process according to claim 9 further comprising the additional step of cutting said tubular form near the upper edge to a desired height.

12. The process according to claim 9, further comprising the additional steps of:

permitting said concrete to partially cure; and then removing said stabilizing member.

* * * * *